US007595287B2

(12) United States Patent
Whitman

(10) Patent No.: US 7,595,287 B2
(45) Date of Patent: Sep. 29, 2009

(54) COMPOSITION FOR USE WITH CLIPPER BLADES

(76) Inventor: Ralph Whitman, 510 Simons St., Coleman, MI (US) 48618

( * ) Notice: Subject to any disclaimer, the term of this patent is extended or adjusted under 35 U.S.C. 154(b) by 287 days.

(21) Appl. No.: 10/678,398

(22) Filed: Oct. 3, 2003

(65) Prior Publication Data

US 2004/0067859 A1 Apr. 8, 2004

Related U.S. Application Data

(60) Provisional application No. 60/416,690, filed on Oct. 7, 2002.

(51) Int. Cl.
*C10M 173/02* (2006.01)

(52) U.S. Cl. ..... 508/216; 508/220; 510/109; 510/401; 510/437; 510/463; 424/73

(58) Field of Classification Search ..... 508/220, 508/216; 510/109, 401, 437, 463; 424/73
See application file for complete search history.

(56) References Cited

U.S. PATENT DOCUMENTS

| | | | | |
|---|---|---|---|---|
| 3,056,745 | A * | 10/1962 | Morschel et al. | 252/78.5 |
| 4,853,247 | A * | 8/1989 | Barcelon et al. | 426/613 |
| 4,963,351 | A * | 10/1990 | Weston | 424/73 |
| 5,007,533 | A | 4/1991 | Purohit | |
| 5,102,567 | A * | 4/1992 | Wolf | 508/563 |
| 5,147,575 | A * | 9/1992 | Hampton, Sr. | 422/28 |
| 5,251,752 | A | 10/1993 | Purohit | |
| 5,334,581 | A * | 8/1994 | Behan et al. | 512/2 |
| 5,370,881 | A | 12/1994 | Fuisz | |
| 5,538,653 | A * | 7/1996 | Avery et al. | 508/229 |
| 5,618,779 | A * | 4/1997 | Klein et al. | 508/486 |
| 5,716,602 | A | 2/1998 | Uick | |
| 5,756,081 | A * | 5/1998 | Wdowik | 424/73 |
| 6,039,937 | A | 3/2000 | Neubauer | |
| 6,415,800 | B2 * | 7/2002 | Poisson et al. | 132/200 |
| 6,792,960 | B2 * | 9/2004 | Peele et al. | 134/104.2 |
| 2001/0003586 | A1 | 6/2001 | Vatter et al. | |
| 2002/0082188 | A1 | 6/2002 | Baker et al. | |
| 2002/0086039 | A1 | 7/2002 | Lee et al. | |
| 2005/0032653 | A1 * | 2/2005 | Kunz et al. | 508/216 |

FOREIGN PATENT DOCUMENTS

EP 654259 A1 * 5/1995

OTHER PUBLICATIONS

Lewis, Sr., Richard J.; Hawley's Condensed Chemical Dictionary 13th Ed., John Wiley & Sons, New York, 1997 (p. 818).*

* cited by examiner

*Primary Examiner*—Bernard Lipman
(74) *Attorney, Agent, or Firm*—Burgess Law Office, PLLC

(57) ABSTRACT

A composition for use with clipper blades of the type used for cutting hair. The composition including a base ingredient typically comprising mineral oil and also including at least one additional member selected from the group of spearmint oil, peppermint oil, fatty acids, fatty oils, hydraulic oil or mixtures thereof.

3 Claims, No Drawings

COMPOSITION FOR USE WITH CLIPPER BLADES

FIELD OF THE INVENTION

The present invention relates generally to compositions for use with hair cutting equipment, and more specifically to liquids for use with clipper blades. The clipper blades may be mechanically driven and moving while immersed in the solution; stored in the solution; or routinely "dabbed" with small amounts of the solution before, during, and after use. It should be understood that the solution of the present invention helps to disinfect, clean the debris out from between the parts of the clipper blades, prolong the sharpened or cutting edge thereof by reducing any deterioration caused by the oxidation or other deposits formed on the blade surface, and lubricate the clipper blades which, in turn, keeps the blades cool during operation.

BACKGROUND OF THE INVENTION

Mechanically driven clipper blades, especially those used on animals, typically operate in a rugged environment. Generally, the clipper blades are not cleaned or disinfected between uses. This practice typically leaves hair or debris in and on the clipper blades. The debris often contains bacteria, which passes from one person or animal to the next when using the same clipper blades. In addition, during operation, unless a suitable lubricant is applied to the clipper blades, heat caused by friction between the blades builds up, which reduces the efficiency of the clippers and can cause discomfort if the blades touch the animal's skin during the cutting operation. Finally, unless the clipper blades are properly cared for, rust or corrosion along with deposit buildup may harm the blades, can dull the cutting edge and reduce the overall useful life of the clipper blades.

It is known to use an existing solution containing petroleum solvents to clean and store clipper blades. Such a solution has several disadvantages including the possibility that it may cause severe skin irritation. In addition, it is also known to store razor blades in mineral oil to reduce deposit build-up.

Accordingly, there exists a need for a new and improved composition, and method for using the same, for cleaning and disinfecting clipper blades and the like.

SUMMARY OF THE INVENTION

Accordingly, the present invention provides a composition suitable for use with clipper blades, scissors, and various grooming tools. The composition including a base ingredient such as mineral oil, combined with spearmint oil and/or peppermint oil. The composition may also include, among other things, a non-hazardous wear preventative agent, a non-hazardous corrosion inhibiting agent, fatty acids such as fish oil or emu oil, and oleic acid.

Additional advantages and features of the present invention will become apparent from the following description and appended claims, taken in conjunction with the accompanying drawings.

DETAILED DESCRIPTION OF THE INVENTION

In the preferred embodiment, the composition of the present invention is comprised of a liquid having a multipurpose use with hair cutting tools such as mechanically driven clipper blades, scissors and related grooming tools. In its simplest form, the composition includes a base ingredient such as a non-hazardous mineral oil, that is combined with other oils, including but not limited to spearmint oil, and/or peppermint oil. The term "Mineral oil," as used herein, includes any form of non-toxic synthetic or organic mineral oil or suitable substitute therefor. The composition may also include wear preventative agents, corrosion inhibiting agents, hydraulic oils, fish oils, emu oils, fatty acids, fatty oils, dyes, and/or fragrances.

Generally, the preferred embodiment of the composition of the present invention will contain the ingredients in an amount as set forth below. A base ingredient that preferably comprises approximately 80%-98% by volume, based on the total volume of the composition. The base ingredient is typically mineral oil and may include a food grade white mineral oil of the type that is readily and commercially available from Petro-Canada (Chicago, Ill.).

The composition also preferably includes botanical oils such as, by way of example, spearmint and/or peppermint oils. In the preferred embodiment, spearmint oil comprises approximately 0.015% by volume based on the total volume of the composition. "Spearmint oil," as that term is used herein includes any other non-toxic synthetic or organic oil, having medicinal or non-medicinal properties which may enhance the formula's performance. Specifically, when used herein, the spearmint oil may function as a local anesthetic to assist with minor skin abrasions or as an astringent. Accordingly, substitution of any other oil that performs this function would come within the scope of the invention.

Peppermint oil preferably comprises approximately 0.015% by volume. "Peppermint oil," as that term is used herein includes any other non-toxic synthetic or organic oil, having medicinal properties which may enhance the formula's performance. Specifically, when used herein, the peppermint oil may function as an antiseptic, anti-microbial agent, fungicide or an anti-viral agent. Accordingly, substitution of any other oil that performs this function would come within the scope of the invention.

The combination of spearmint oil and peppermint oil is shown herein in the neighborhood of 0.03% by volume, based on the total volume of the composition. This is by way of example only. The percent by volume of spearmint oil and/or peppermint oil, or other essential oils may rise to a level of 15% by volume based on the total volume of the composition. It should be appreciated that the limiting factor as to the amount of peppermint or spearmint oil is primarily the cost thereof. Assuming a low cost supply, the volume of spearmint, peppermint, similar essential oils, other botanical oils or combination thereof may be as high as 100%.

In addition to the botanical oils, the composition may also include animal oils such as, by way of example, fish and/or emu oil. Fish oil, as used in the preferred embodiment, comprises approximately 0.03% by volume based on the total volume of the composition. Fish oil or other Omega-3 oils, including those obtained from vegetable oil, as used herein, include any other non-toxic synthetic or organic oil, having medicinal or non-medicinal properties which may enhance the formula's performance. Specifically, when used herein the fish oil, Omega-3 oil or other fatty acids may function as a natural antiinflammatory agent, a natural anti-oxidant, it may accelerate healing and may produce an enhanced hair coat. Accordingly, substitution of any other oil that performs this function would come within the scope of the invention.

Emu oil, as used in the preferred embodiment, comprises approximately 0.07% by volume based on the total volume of the composition and can be used in addition to or separate from the fish oils, Omega-3 oils or other fatty acids set forth above. Emu oil, as used herein, includes any other non-toxic synthetic or organic oil, having medicinal or non-medicinal properties which may enhance the composition's performance. Specifically, Emu oil when used herein, may function to reduce eczema, inflammation, itching, scabbiness, swelling, soften calloused feet, reduce razor burn and nicks, alleviate itching or bug and flea bites, act as a deep-penetrating moisturizer and as an anti-septic. Accordingly, substitution of any other oil that performs this function would come within the scope of the invention.

Oleic acid, as used in the preferred embodiment, comprises approximately 0.03% by volume based on the total volume of the composition. Oleic acid, as used herein, includes any other non-toxic synthetic or organic fatty acid, having medicinal and non-medicinal properties to enhance the formula's performance. Specifically, the oleic acid, when used herein, may function as an adhering agent that helps the composition to adhere to the cutting blade or tool. Accordingly, substitution of any other acid that performs this function would come within the scope of the invention.

It should be understood that the fish oil, Emu oil and oleic acid as set forth above, are fatty acids. Accordingly, the percent by volume of fatty acids used in the inventive composition of the present invention may vary greatly. It is contemplated that the inventive composition may include up to 100% by volume fatty acids based on the total volume of the composition. Further, the composition may include fatty acids in an amount less than 100% by volume mixed with any of the other ingredients set forth herein. For instance, the fatty acids may be combined with mineral oil or food grade anti-wear hydraulic oil, such as those readily and commercially available from Petro-Canada or a combination thereof to obtain the composition of the present invention.

Coloring or dye, as used in the preferred embodiment, comprises approximately 0.004% by volume based on the total volume of the composition. The coloring or dye is preferably non-toxic and primarily acts as a mechanism to eliminate confusion between this formula and other products. The dye can be any color.

Fragrance, as used in the preferred embodiment, comprises 0.06% by volume based on the total volume of the composition. The spearmint or peppermint oil or other oils used typically, emit an odor that in some cases may be undesirable. For instance, the spearmint and peppermint oils may emit a medicinal/menthol odor, which can be strong. Accordingly, a fragrance may be added. Any non-toxic fragrance can be used for this purpose. In the preferred embodiment, a fragrance having a fruity/floral scent is used. If no fragrance is desired, then the fragrance can be omitted leaving the composition with a prevailing menthol odor.

In addition, the preferred embodiment may include vitamin E, (e.g. tocopherols) in an amount of 0.001%-5.0% by volume. The vitamin E is preferably added to the composition as a skin conditioner.

In addition to its nontoxic, non-irritating, hypoallergenic, reduced sensitivity and disinfecting qualities, the preferred embodiment of the composition may also include a suitable wear preventative agent such as food grade anti-wear hydraulic oil, readily and commercially available from Petro-Canada. The hydraulic oil may replace the mineral oil as the basic ingredient and comprises up to 99% by volume of the composition. Or, the mineral oil and hydraulic oil may be combined in other amounts, including the composition having 49% food grade mineral oil and 49% food grade anti-wear hydraulic oil combined together with the remainder being made up of botanical oils or fatty acids as set forth above.

It should be understood that one advantage of the hyraulic oil is that it helps to reduce heat buildup during operation of the clipper blades. During operation, the clipper blades may become hot and thereby cause severe irritation when touching the skin. The composition of the present invention lubricates the blades and correspondingly reduces the amount of heat generated during typical operation.

In addition, the composition may also include a suitable corrosion inhibiting agent. For instance, the hydraulic oil set forth above may already include the corrosion inhibiting agent. Accordingly, the composition is also beneficial in that it aids by reducing rust and corrosion on the clipper blade. Specifically, the base material being oil, such as mineral oil, operates to coat the blade surface and prevent the formation of rust and corrosion. Also, when the blades are soaked or stored in the composition, additional corrosion and oxidation is prevented along with the attachment of deposits, such as mineral deposits that may form on the cutting blade during conventional cleaning.

It should be understood that the present composition may be used as a storage/soaking solution into which the cutting tools including clipper blades, may be dipped and/or stored prior to use. Accordingly, when used as a solution, the composition disinfects the clipper blades in a non-toxic, hypoallergenic and non-irritating manner before, during, and after each use. While the preferred embodiment uses a combination of the spearmint oil, peppermint oil, emu oil, fish oil, and oleic acid, other botanical oils and fatty acids that provide similar properties could also be used. It should be recognized that as utilized within the composition, the spearmint oil has uniquely different qualities, and thus performs a different function than that of the peppermint oil. Specifically, the spearmint oil acts as a local anesthetic and as an astringent, while the peppermint oil functions, as set forth above, as an antiseptic. The animal oils, i.e., the emu oil and/or fish oil, provide unique characteristics that differ from the botanical oils such as spearmint oil and peppermint oil.

The ingredients of the present invention combined to form a composition for use with cutting tools, including clipper blades for cutting hair, that aids in disinfecting and protecting the clipper blades while at the same time reducing and soothing any irritation to the skin occurring during the haircutting or clipping process. Further, the present invention may be used as a soaking/storage solution to further protect the clipper blades when not in use.

The foregoing discussion discloses and describes merely exemplary embodiments of the present invention. One skilled in the art will readily recognize from such discussion and from the accompanying drawings and claims that various changes, modifications and variations can be made therein without departing from the spirit and scope of the invention as defined in the following claims.

What is claimed is:

1. A composition suitable for use with clipper blades comprising:

a mineral oil based ingredient or synthetic thereof;
spearmint oil or synthetic thereof;
peppermint oil or synthetic thereof;
fish oil or synthetic thereof;
emu oil or synthetic thereof;
a fatty acid or synthetic thereof;
a dye, including a synthetic or organic thereof;
a fragrance including a synthetic or organic thereof; and
an anti-wear/non-corrosive additive or synthetic thereof.

2. The composition of claim 1 further comprising vitamin E.

3. A composition suitable for use with clipper blades comprising:

a mineral oil based ingredient or synthetic thereof;
spearmint oil or synthetic thereof;
peppermint oil or synthetic thereof;
emu oil or synthetic thereof;
a fatty acid or synthetic thereof;
a fragrance including a synthetic or organic thereof; and
an anti-wear/non-corrosive additive or synthetic thereof.

* * * * *